US007167088B2

(12) United States Patent
Farley

(10) Patent No.: US 7,167,088 B2
(45) **Date of Patent: *Jan. 23, 2007**

(54) WIRELESS WALK THROUGH TEST SYSTEM

(75) Inventor: Daniel G. Farley, Westminster, MA (US)

(73) Assignee: SimplexGrinnell LP, Westminster, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/195,922

(22) Filed: Aug. 3, 2005

(65) Prior Publication Data

US 2005/0280527 A1 Dec. 22, 2005

Related U.S. Application Data

(63) Continuation-in-part of application No. 10/733,979, filed on Dec. 11, 2003, now Pat. No. 6,950,016, which is a continuation of application No. 10/144,161, filed on May 10, 2002, now Pat. No. 6,737,967.

(51) Int. Cl.
*G08B 29/00* (2006.01)

(52) U.S. Cl. ..... 340/514; 340/506; 340/516

(58) Field of Classification Search ..... 340/500, 340/502, 503, 504, 505, 506, 514, 515, 516, 340/524, 531, 539.1, 539.13, 539.14, 628, 340/629, 630; 455/67.1, 67.4, 67.6; 379/18, 379/29.02

See application file for complete search history.

(56) References Cited

U.S. PATENT DOCUMENTS

| | | | | |
|---|---|---|---|---|
| 4,032,909 | A * | 6/1977 | Boyce | 340/514 |
| 4,141,007 | A | 2/1979 | Kavasilios et al. | |
| 4,148,019 | A | 4/1979 | Durkee | |
| 4,412,211 | A | 10/1983 | Lautzenheiser et al. | |
| 4,427,974 | A | 1/1984 | Sheahan | |
| 4,459,582 | A | 7/1984 | Sheahan et al. | |
| 4,538,138 | A | 8/1985 | Harvey et al. | |
| 4,556,873 | A * | 12/1985 | Yamada et al. | 340/630 |
| 4,639,557 | A | 1/1987 | Butler et al. | |
| 4,652,859 | A | 3/1987 | Van Wienen | |
| 4,656,319 | A * | 4/1987 | Bially | 379/29.01 |
| 4,725,818 | A | 2/1988 | Motyka et al. | |
| 5,686,885 | A | 11/1997 | Bergman | |
| 5,686,896 | A * | 11/1997 | Bergman | 340/636.1 |
| 5,898,368 | A * | 4/1999 | Handley et al. | 340/514 |
| 6,313,744 | B1 | 11/2001 | Capowski et al. | |
| 6,326,880 | B1 | 12/2001 | Tice | |
| 6,529,128 | B2 | 3/2003 | Weng | |
| 6,571,082 | B1 | 5/2003 | Rahman et al. | |
| 6,642,849 | B1 * | 11/2003 | Kondziolka | 340/628 |
| 6,950,016 | B2 * | 9/2005 | Farley | 340/514 |

* cited by examiner

*Primary Examiner*—Van T. Trieu

(57) ABSTRACT

The present invention provides a method and system of walk through testing a fire alarm system without disrupting the building occupants. A communications channel is setup between a control panel and a communicator carried by a human tester. The tester triggers an alarm or trouble condition in a device. The control panel detects the address of the device and automatically returns to the communicator, over the communications channel, the location of the device.

33 Claims, 3 Drawing Sheets

WIRELESS WALK THROUGH TEST SYSTEM

RELATED APPLICATIONS

This is a Continuation-in-Part application of U.S. application Ser. No. 10/733,979 filed on Dec. 11, 2003 issued on Sep. 27, 2005 as U.S. Pat. No. 6,950,016), which is a Continuation of U.S. application Ser. No. 10/144,161 filed on May 10, 2002 (issued on May 18, 2004 as U.S. Pat. No. 6,737,967), which are incorporated herein by reference in their entirety.

BACKGROUND OF THE INVENTION

Typical building fire alarm systems include a number of fire detection devices located throughout a building. The devices include smoke detectors, heat sensors, pull stations and like devices. Normally, these devices are connected in loops and are monitored for alarm and trouble conditions at a central control panel. The loops are distributed throughout zones of an industrial plant, office or residential building.

Alarm and/or trouble indicators are located at the control panel to indicate in which zone the alarm and/or trouble condition is located. The alarm or trouble indicators may be LEDs and/or an alphanumeric display. A yellow LED usually indicates a trouble condition and a red LED usually indicates an alarm condition. A trouble condition may be caused by the removal of a device, faulty system wiring and the like. A tone alarm may be generated at the control panel to announce that a trouble condition has been detected. The tone alarm can be silenced by an operator authorized access to the control panel. During an alarm condition, audible devices are sounded throughout the zones of the building. These devices may include horns, bells and like devices. Light strobes may also be located throughout the building to provide a visual alarm.

A walk through test of each device verifies that each device is connected to the system in its assigned location. Before performing a walk through test, a human tester places the control panel in a test mode. When performing a walk through test, the tester places a device in an alarm or trouble condition. The control panel receives a signal from a sensing device identifying the location of the device and whether there is an alarm or trouble condition. The tester then must communicate with the control panel operator as to whether the alarm or trouble condition was properly detected by the control panel and whether the device is located in the proper zone. A communications channel is setup between the tester and a control panel operator. The communication channel may be set up through a pair of two-way radios, cellular phones or like devices. The control panel operator then resets the alarm or trouble condition at the control panel and the tester moves onto the next device to be tested.

A single tester walk through test such as presented in U.S. Pat. No. 4,725,818, allows the tester to place a device in an alarm or trouble condition. In test mode, the control panel senses the location of the device and whether there is an alarm or trouble condition. The control panel then audibly sounds a code, associated with the devices address, throughout the audible devices located in the system or zone. The tester listens to the code and verifies the location of the device by matching the code to a list of device addresses for all devices in the system. The control panel automatically resets the tripped device so the tester can move to the next device to test.

SUMMARY OF THE INVENTION

The single human tester method of verifying system installation and troubleshooting alarm devices can be very disruptive, not only to the tester but to the building occupants. This is especially important in buildings which do not typically have an unoccupied period during which testing can be preformed, such as hospitals. Also, only the device address is communicated to the tester and not the device location. Therefore, even though the system has the capability of conducting the verification with one tester, many tests are conducted with two people, a tester and control panel operator.

In accordance with the present invention there is provided a method and system of walk through testing a fire alarm system without disrupting the building occupants.

This result is achieved by setting up a communications channel between the control panel and a communicator carried by the tester. The tester then triggers a test condition in a device. The control panel detects the address or identifier of the device and automatically returns to the communicator, over the communications channel, an indication of a location of the device. The indication may be a code associated with the device address which can be matched to location on a list. However, it is preferred that the indication be a direct identification of location such as presented in a label associated with the device address at the control panel.

The location of the devices may be a label that may be converted to a voice stream or textual message, which is transmitted to the tester over the communication channel. In response to the label, the tester can transmit over the communications channel, a response indicating the location of the device. The response may be stored in a storage device, and the response may be associated with the device tested. The response can be either a voice stream or textual message and the storage device may be a computer. The test condition may be an alarm or trouble condition.

An address of the device can also be returned to the tester. The tester transmits over the communications channel the response to the address of the device. The response is then stored in a storage device, and the response may be associated to the device tested. The response can be either a voice stream or textual message and the storage device may be a computer.

To set up a communications channel between the control panel and the tester, a computer may be connected to the control panel. A first communications device may be connected to the computer and a second communications device (communicator) may be connected to the first communications device through a wireless connection. The communicator device can be a handheld or portable device carried (for example, literally carried, or perhaps worn) by the tester, and can be, for example, a two-way radio, cellular phone or pager interface.

A method of walk test in an alarm system according to an embodiment of the present invention thus includes setting up a communications channel between a control panel and a communicator carried (for example, carried or worn) by a human tester. The communicator is easily transported by the tester during his or her walk-around, e.g., it may be a handheld or portable device. The tester then triggers a test condition in a device at the device. At the control panel the triggered test condition is detected. Finally, an indication of a location of the device is returned to the communicator over the communications channel.

The communicator may be, for example, a personal digital assistant (PDA), a Bluetooth-compatible communication device, a WiFi-compatible communication device, a wireless networking device (such as a Blackberry™ device), a two-way radio, a cellular phone, a pager, or the like.

A further embodiment of the present invention includes generating a report of missed devices. The report may be printed, for example on paper, or may be communicated to the communicator, where some or all of the report is communicated to the tester, for example by displaying the report (or portion of the report) on the communicator or on a separately connected device such as a laptop or desktop computer. Alternatively, the report may list the status of both tested and untested (missed) devices.

A device being tested can be any device typically found in a fire alarm system, including detectors such as smoke detectors, heat sensors, gas sensors, flame detectors, and pull stations, and addressable notification appliances such as speakers, horns, strobes and the like.

The above and other features of the invention including various novel details of construction and combinations of parts, and other advantages, will now be more particularly described with reference to the accompanying drawings and pointed out in the claims. It will be understood that the particular method and device embodying the invention are shown by way of illustration and not as a limitation of the invention. The principles and features of this invention may be employed in various and numerous embodiments without departing from the scope of the invention.

BRIEF DESCRIPTION OF THE DRAWINGS

In the accompanying drawings, reference characters refer to the same parts throughout the different views. The drawings are not necessarily to scale; emphasis has instead been placed upon illustrating the principles of the invention. Of the drawings.

DETAILED DESCRIPTION OF THE PREFERRED EMBODIMENTS

Figure 1A:
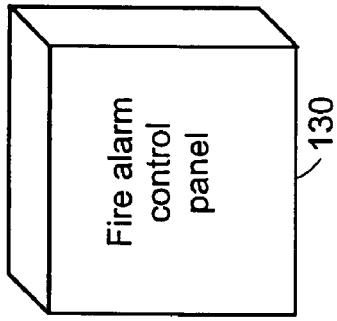
FIGS. 1 and 1A illustrate a fire alarm system showing a building's floor plan highlighting the zones of the fire alarm system.
Figure 1:
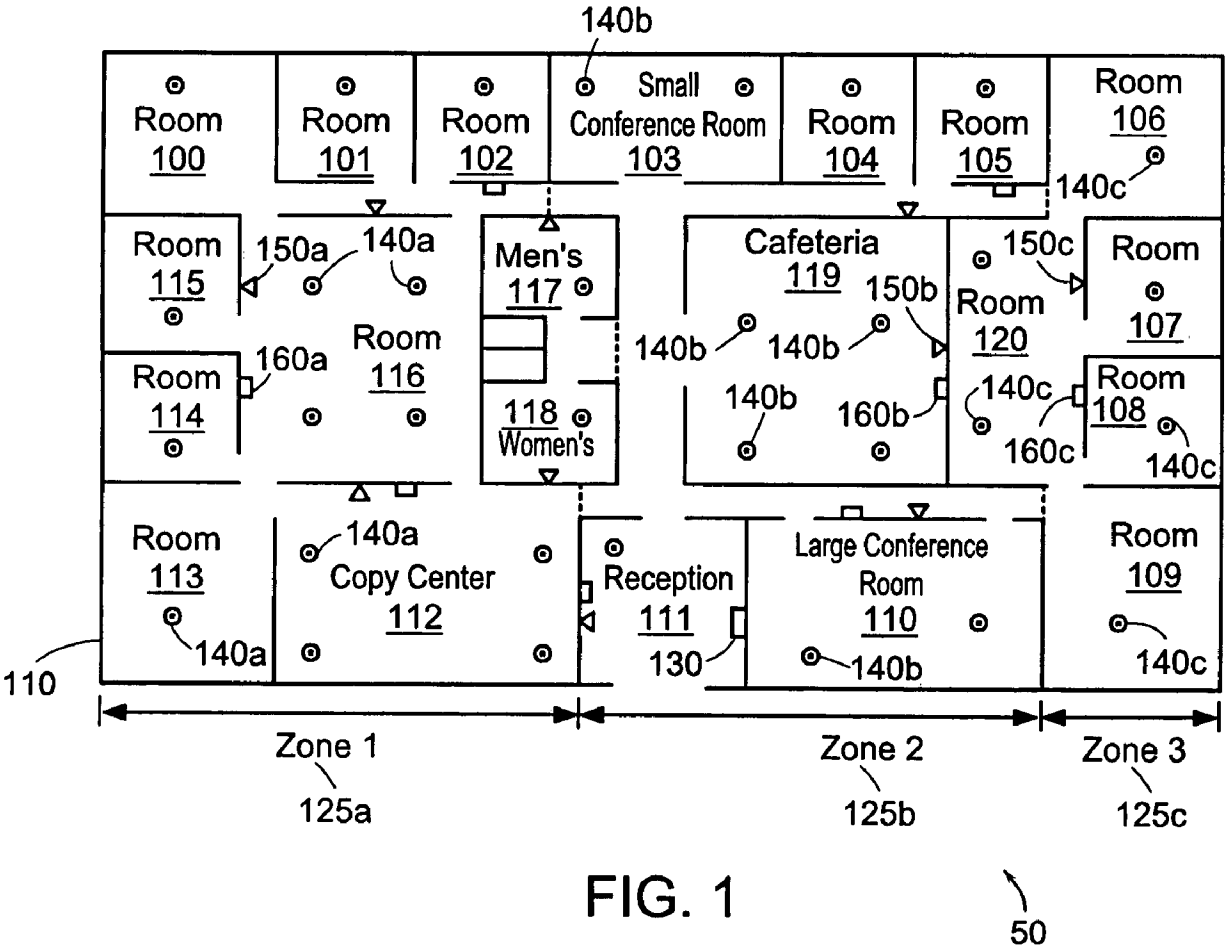

FIG. 1 shows a general layout of a building fire alarm system. Typically, fire alarm system 50 warns the buildings occupants and the local fire department of a potential fire emergency located within the building 110. The building 110 can be an industrial plant, office or residential building. The building 110 is divided into zones 125 to allow for accurate location of the fire emergency. As shown in FIG. 1, there are three zones 125*a*, 125*b* and 125*c*, respectively. However, it should be noted that there can be as many as N zones on M floors of the building 110 or multiple buildings. A central control panel 130 (also shown in FIG. 1A) monitors each zone for potential fire emergencies and trouble conditions.

Sensing devices 140, audio/visual devices 150 and pull stations 160 are strategically located within each zone 125 of the building 110 to provide for proper coverage. Sensing devices 140 are designated 140*a*, 140*b* and 140*c* for zones 125*a*, 125*b* and 125*c*, respectively. Audio/visual devices 150 are designated 150*a*, 150*b* and 150*c* for zones 125*a*, 125*b* and 125*c*, respectively. Pull stations 160 are designated 160*a*, 160*b* and 160*c* for zones 125*a*, 125*b* and 125*c*, respectively. The sensing devices 140 can be smoke, thermal detectors or like devices. The audio/visual devices 150 can be horns, bells, strobe lights or a combination thereof.

Figure 2A:
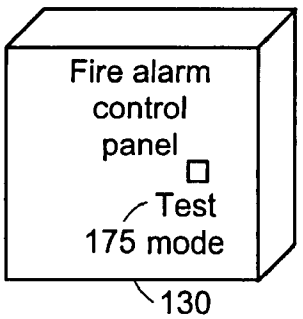
FIGS. 2 and 2A illustrate the fire alarm system of FIG. 1 being walk tested by a single tester without disturbing the buildings occupants.
Figure 2:
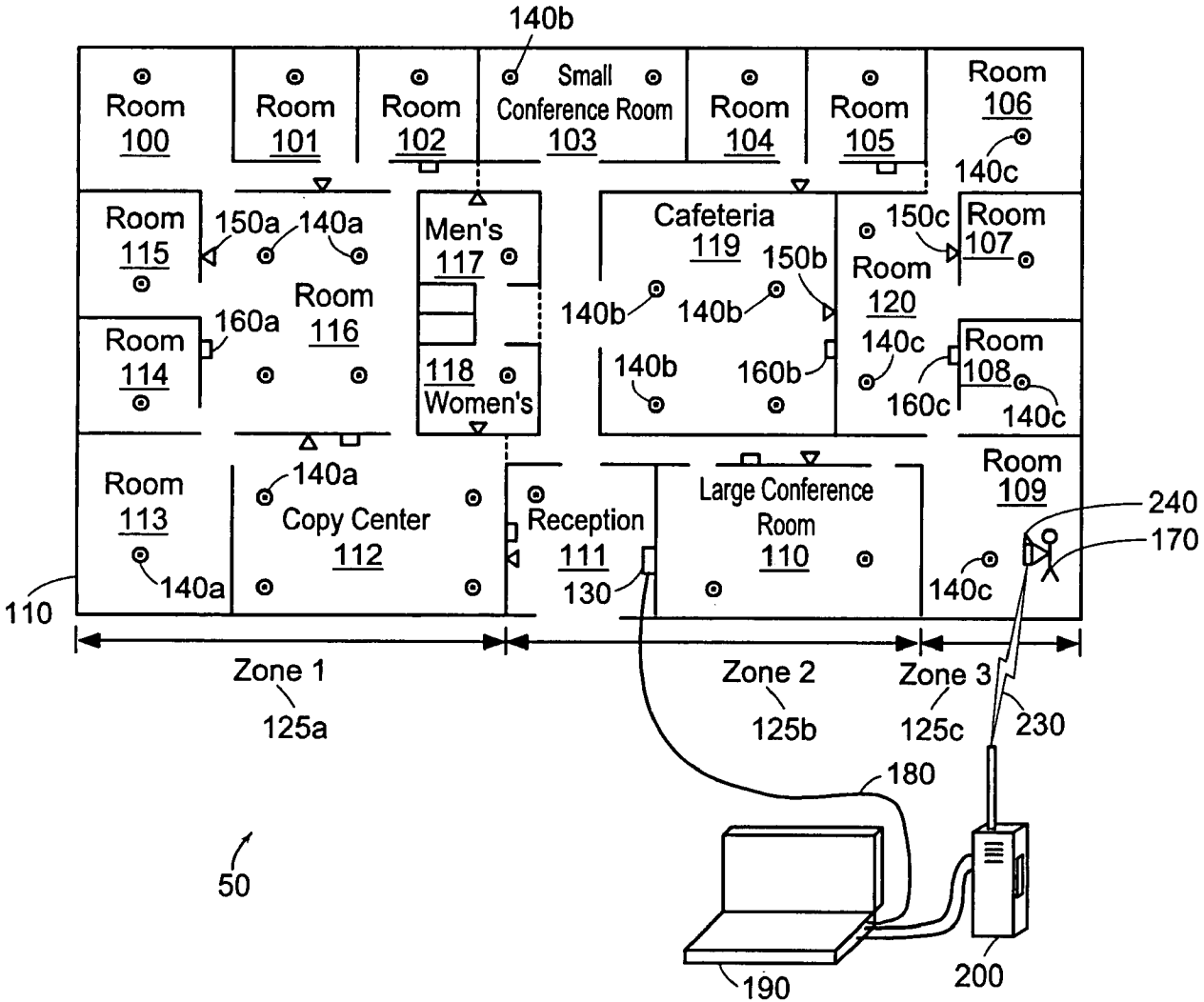

FIG. 2 shows a walk test being conducted by a single tester 170. Before starting the walk test of the alarm system 50, the tester 170 places the control panel 130 (also shown in FIG. 2A) in test mode 175 which disables all audio/visual devices 150 within the system 50. The tester 170 sets up a communications channel 230 between the tester 170 and the control panel 130. The tester 170 connects a computer 190 to the control panel 130 with a cable 180. The cable 180 can be an RS232, ethernet, serial, parallel or any other cable known in the art for connecting a computer 190 to the control panel 130. The computer 190 is connected to a two-way radio 200 through the audio-in, audio-out ports of the computer 190 and radio 200. In another embodiment, the tester 170 can connect a cellular phone or paging transmitter to the computer 190. The computer 190 can connect to a paging company in any way known in the art to send a textual message to the pager or cellular phone. The tester 170 establishes a communications link 230 via a pair of two-way radios, 200 and 240 by selecting the same radio frequency on respective radios 200, 240. The system is now ready to be tested.

The tester 170 places a device (sensing device 140*c*, located in room 109 of zone 125*c*) in an alarm or trouble condition, i.e., trips the device. The tester 170 can place the device in an alarm or trouble condition either by using smoke, magnets, activating (pulling) the pull station, physically removing the device or any other way known in the art. The control panel 130 detects the condition of the tripped device and sends a message to the computer 190 containing the location (room 109) and/or address of the tripped device (140*c*).

The computer 170 converts the message received from the control panel 130 to a voice stream and sends the voice stream to the tester 170 over the communications link 230 established between the radios 200 and 240. The tester 170 hears the location (room 109) and/or address of the tripped device (140*c*) and verifies if the device is wired correctly, i.e., located in the correct location and zone. In another embodiment, the computer 170 can send a textual message to the pager or an e-mail message to the cellular phone.

The tester 170 can relay a voice or textual message back to the computer 170 as to whether the device (140*c*) is wired correctly, i.e., located in the correct location and zone (room 109, zone 125*c*). The computer 170 stores the voice or textual message received from the tester 170 and associates it to the device tested (sensing device 140*c*, located in room 109 of zone 125*c*). The control panel 130 resets the system so the next device can be tested. The tester 170 moves to the next device until all devices in the alarm system 50 have been verified.

Figure 3A:
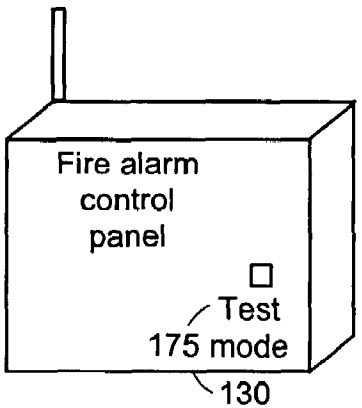
FIGS. 3 and 3A illustrate an alternative embodiment of the fire alarm system of FIG. 2.
Figure 3:
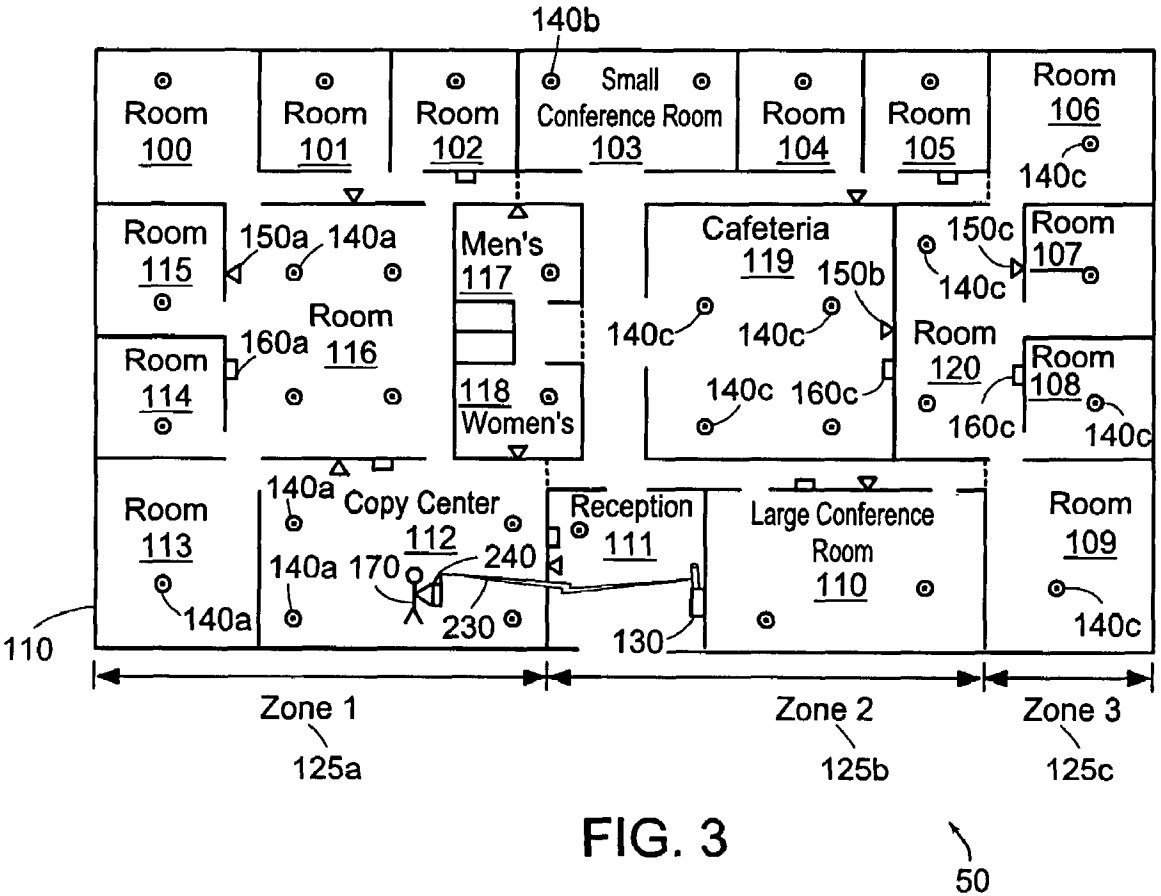

In another embodiment as shown in FIG. 3, the control panel 130 (also shown in FIG. 3A) can be made to incorporate the functions of the computer 190 and/or the radio 200, cellular phone or paging transmitter. If the computer 190 is incorporated into the control panel 130, the radio, cellular phone, pager or other handheld/portable communicator can be connected to the control panel 130.

While this invention has been particularly shown and described with references to preferred embodiments thereof, it will be understood by those skilled in the art that various changes in form and details may be made therein without departing from the scope of the invention encompassed by the appended claims.

What is claimed is:

1. A method of walk test in an alarm system, comprising the steps of:

setting up a communications channel between a control panel and a communicator carried by a human tester;

triggering a test condition in a device, by the tester at the device;

at the control panel, detecting the triggered test condition; and returning to the communicator over the communications channel an indication of a location of the device.

2. The method of claim 1, the communicator comprising one of: a personal digital assistant (PDA); a Bluetooth-compatible communication device, a WiFi-compatible communication device, and a wireless networking device.

3. The method of claim 1, further comprising:

generating a report listing at least untested devices.

4. The method of claim 3 wherein the report is printed on paper.

5. The method of claim 3 wherein the report is communicated to the communicator.

6. The method of claim 5 wherein at least a portion of the report is displayed on the communicator.

7. The method of claim 1, the device comprising any of a sensor and a notification appliance device.

8. The method of claim 1, wherein the indication is a direct identification of the location of the device.

9. The method of claim 1, wherein the location indication is returned by:

converting a control panel label to a voice stream or textual message; and transmitting the voice stream or textual message to the communicator over the communications channel.

10. The method of claim 1, further comprising:

the tester transmitting over the communications channel via the communicator a response to the location indication; and storing the response in a storage device, and associating the response with the device tested.

11. The method of claim 10, wherein the response comprises at least one of: a voice stream and a textual message.

12. The method of claim 10, wherein the storage device is a computer.

13. The method of claim 1, wherein the test condition is an alarm condition.

14. The method of claim 1, wherein the test condition is a trouble condition.

15. The method of claim 1, wherein the step of returning the indication of the location of the device further includes returning an address of the device to the tester.

16. An alarm system for walk test, comprising:

an alarm device adapted to be triggered by a human tester at the device to activate a test condition;

a control panel that detects the triggered test condition;

a communications channel between the control panel and a communicator carried by the tester;

an identifier of the device in the test condition being detected by the control panel, and an indication of a location of the device being returned to the communicator over the communications channel.

17. The alarm system of claim 16, the communicator comprising one of: a personal digital assistant (PDA); a Bluetooth-compatible communication device, a WiFi-compatible communication device, and a wireless networking device.

18. The alarm system of claim 16, further comprising:

a report generator which generates a report listing at least untested devices, there being plural alarm devices in the system.

19. The alarm system of claim 18 wherein the report is printed on paper.

20. The alarm system of claim 18 wherein the report is communicated to the communicator.

21. The alarm system of claim 20 wherein at least a portion of the report is displayed on the communicator.

22. The alarm system of claim 16, the device comprising any of a sensor and a notification appliance device.

23. The alarm system of claim 16, wherein the indication is a direct identification of the location of the device.

24. The alarm system of claim 16, wherein a direct identification is returned by:

a voice stream or textual message converted from a control panel label; and a transmitter for transmitting the voice stream or textual message to the communciator over the communications channel.

25. The alarm system of claim 16, wherein the test condition is an alarm condition.

26. The alarm system of claim 16, wherein the test condition is a trouble condition.

27. The alarm system of claim 16, wherein the indication of the location of the device further comprises an address of the device.

28. The alarm system of claim 16, further comprising a storage device for storing a response transmitted by the tester over the communications channel, and for associating the response with the device tested.

29. The alarm system of claim 28, wherein the response comprises at least one of: a voice stream, and a textual message.

30. The alarm system of claim 28, wherein the storage device is a computer.

31. An alarm system for walk test, comprising:

communications means for communicating between a control panel and a communicator carried by a human tester;

means for triggering a test condition in a device, by the tester at the device;

means, at the control panel, for detecting the triggered test condition; and means for returning to the communicator over the communications means an indication of a location of the device.

32. The alarm system of claim 31, further comprising:

means for generating a report listing at least untested devices.

33. The alarm system of claim 32, further comprising:

means for displaying the report.

* * * * *